US007260940B2

(12) United States Patent
Watanabe et al.

(10) Patent No.: US 7,260,940 B2
(45) Date of Patent: Aug. 28, 2007

(54) HEAT PUMP USING GAS HYDRATE, AND HEAT UTILIZING APPARATUS

(75) Inventors: Kenji Watanabe, Yokohama (JP); Tomonari Ito, Chiba (JP); Tomohiro Ogawa, Kawasaki (JP)

(73) Assignee: The Tokyo Electric Power Company, Incorporated, Tokyo (JP)

( * ) Notice: Subject to any disclaimer, the term of this patent is extended or adjusted under 35 U.S.C. 154(b) by 402 days.

(21) Appl. No.: 10/510,394

(22) PCT Filed: Dec. 10, 2003

(86) PCT No.: PCT/JP03/15804

§ 371 (c)(1),
(2), (4) Date: Oct. 4, 2004

(87) PCT Pub. No.: WO2004/055453

PCT Pub. Date: Jul. 1, 2004

(65) Prior Publication Data

US 2005/0155355 A1 Jul. 21, 2005

(30) Foreign Application Priority Data

Dec. 13, 2002 (JP) ..... 2002-362554

(51) Int. Cl.
*F25D 5/00* (2006.01)
*F25B 23/00* (2006.01)

(52) U.S. Cl. ..... 62/4; 62/114; 62/467

(58) Field of Classification Search ..... 62/46.2, 62/114, 324.2, 467, 4
See application file for complete search history.

(56) References Cited

U.S. PATENT DOCUMENTS 4,718,242 A * 1/1988 Yamauchi et al. ..... 62/467
4,821,794 A * 4/1989 Tsai et al. ..... 165/104.17
4,873,842 A * 10/1989 Payre et al. ..... 62/480
5,140,824 A * 8/1992 Hunt ..... 62/59
6,059,016 A * 5/2000 Rafalovich et al. ..... 165/41
6,634,183 B1 * 10/2003 Jonsson et al. ..... 62/476

FOREIGN PATENT DOCUMENTS

| | | |
|---|---|---|
| JP | 05-180522 | 7/1993 |
| JP | 10/253155 | 9/1998 |
| JP | 2003-139357 | 5/2003 |

OTHER PUBLICATIONS

Machine translation of Japanese reference 05-180522.*

* cited by examiner

*Primary Examiner*—William C Doerrler
(74) *Attorney, Agent, or Firm*—Knobbe Martens Olson & Bear LLP

(57) ABSTRACT

The object of the present invention is to provide a heat pump having a high coefficient of performance (COP), and a heat utilizing apparatus that allows the obtaining of high energy efficiency by using that heat pump.

The heat pump, comprising a refrigerant circuit 13 that contains a decomposer 20 in which a gas hydrate decomposition process is carried out and a former 25 in which a gas hydrate formation process is carried out. This refrigerant circuit 13 imparts heat to a high-temperature object in the gas hydrate formation process by taking up heat from a low-temperature object in the gas hydrate decomposition process. In addition, the heat pump comprises at least an excess water separator 40 that separates excess water from the gas hydrate formed in former 25, or a compression system that sends gas and liquid which are decomposition products of the gas hydrate decomposed in decomposer 20 to former 25 after compressing and mixing.

13 Claims, 3 Drawing Sheets

HEAT PUMP USING GAS HYDRATE, AND HEAT UTILIZING APPARATUS

TECHNICAL FIELD

The present invention relates to a heat pump that allows the obtaining of a high coefficient of performance and a heat utilizing apparatus that uses that heat pump.

Furthermore, the present application is based on a patent application filed in Japan (Japanese Patent Application No. 2002-362554), the content of which is partially incorporated herein by reference.

BACKGROUND ART

In general, heat pumps are devices that impart heat to a high-temperature object by taking up heat from a low-temperature object using a cycle consisting of the steps of evaporation, compression, condensation and expansion. Due to their comparatively high energy utilization efficiency, heat pumps are widely used in heat utilizing apparatuses such as air-conditioners having cooling and heating functions and refrigerators (see, for example, Japanese Unexamined Patent Application, First Publication No. 10-253155).

In a heat pump, heat is absorbed from the surroundings by the latent heat of evaporation during evaporation of a cooling medium. In the case of using in an air-conditioner, heat absorbed during evaporation is supplied from interior air during cooling, and is supplied from the atmosphere during heating. In addition, heat pumps generate heat during condensation of a cooling medium. In the case of using in an air-conditioner, heat generated during condensation is released into the atmosphere during cooling and released into the interior during heating. Examples of cooling media involved in the transfer of heat include fluorocarbon-based compounds as well as ammonia.

The energy utilization efficiency of heat pumps is typically represented with the coefficient of performance (COP), which is the ratio of output heating value to input motive power. Conventionally, high-performance heat pumps had a COP of 2.5 to 4.0. Accompanying the increasing awareness of environmental issues, there is a need to further improve energy efficiency.

DISCLOSURE OF THE INVENTION

In consideration of the aforementioned circumstances, an object of the present invention is to provide a heat pump having a high coefficient of performance (COP).

In addition, another object of the present invention is to provide a heat utilizing apparatus that allows the obtaining of high energy efficiency.

In order to achieve the aforementioned objects, a first heat pump as claimed in the present invention comprises a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process. The first heat pump also comprises an excess water separator that separates excess water from the gas hydrate formed in the former.

According to the aforementioned first heat pump, a high COP is obtained by utilizing the transfer of heat accompanying the gas hydrate decomposition and formation processes. In addition, as a result of separating excess water from the gas hydrate formed in the former, temperature increases of the object sent to the decomposer are inhibited and the decomposition of the gas hydrate is increased.

In the aforementioned first heat pump, an excess water return system should be provided that returns excess water separated in the excess water separator to the former while maintaining its temperature.

A second heat pump as claimed in the present invention comprises a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process. The second heat pump also comprises a compression system that sends gas and liquid which are decomposition products of the gas hydrate decomposed in the decomposer to the former after compressing and mixing.

The aforementioned compression system may employ a constitution that compresses the gas and liquid while mixing, a constitution that separately compresses the gas and liquid followed by their mutual mixing, or a constitution that mixes the gas and liquid followed by compressing the mixture thereof.

According to the aforementioned second heat pump, a high COP is obtained by utilizing the transfer of heat accompanying the gas hydrate decomposition and formation processes. In addition, as a result of sending the gas and liquid that are decomposition products of the gas hydrate to the former after compressing and mixing, the temperature of the object sent to the former is optimized thereby increasing the formation efficiency of the gas hydrate.

In the aforementioned second heat pump, the mixing ratio of the gas and liquid should be determined based on the formation temperature of the gas hydrate in the former.

A third heat pump as claimed in the present invention comprises a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process. The third heat pump also comprises an excess water separator that separates excess water from the gas hydrate formed in the former, and a compression system that sends gas and liquid which are decomposition products of the gas hydrate decomposed in the decomposer to the former after compressing and mixing.

According to the aforementioned third heat pump, a high COP is obtained by utilizing the transfer of heat accompanying the gas hydrate decomposition and formation processes. In addition, as a result of separating excess water from the gas hydrate formed in the former, temperature increases of the object sent to the decomposer are inhibited and the decomposition of the gas hydrate is increased. Moreover, as a result of sending the gas and liquid that are decomposition products of the gas hydrate to the former after compressing and mixing, the temperature of the object sent to the former is optimized thereby increasing the formation efficiency of the gas hydrate.

A fourth heat pump as claimed in the present invention comprises a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process. The fourth heat pump also comprises an auxiliary fluid supply system that supplies an auxiliary fluid for enhancing the fluidity of the gas hydrate to the inlet section of the decomposer.

According to the aforementioned fourth heat pump, a high COP is obtained by utilizing the transfer of heat accompanying the gas hydrate decomposition and formation processes. In addition, as a result of supplying an auxiliary fluid, the fluidity of the gas hydrate in the decomposer is increased, thereby preventing problems during transport as well as increasing the decomposition efficiency of the gas hydrate.

In the aforementioned fourth heat pump, the auxiliary fluid is preferably a portion of the decomposition liquid of the gas hydrate decomposed in the decomposer.

In this case, a valve should be disposed at the outlet section of the decomposer that extracts a portion of the decomposition liquid of the gas hydrate and sends the decomposition liquid to the aforementioned auxiliary fluid supply system.

A fifth heat pump as claimed in the present invention comprises a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process. The fifth heat pump also comprises an auxiliary fluid supply system that supplies an auxiliary fluid for enhancing the fluidity of the gas hydrate to the inlet section of the decomposer, and a compression system that sends gas and liquid which are decomposition products of the gas hydrate decomposed in the decomposer to the former after compressing and mixing.

According to the aforementioned fifth heat pump, a high COP is obtained by utilizing the transfer of heat accompanying the gas hydrate decomposition and formation processes. In addition, as a result of supplying an auxiliary fluid, the fluidity of the gas hydrate in the decomposer is increased, thereby preventing problems during transport as well as increasing the decomposition efficiency of the gas hydrate. Moreover, as a result of sending the gas and liquid that are decomposition products of the gas hydrate to the former after compressing and mixing, the temperature of the object sent to the former is optimized thereby increasing the formation efficiency of the gas hydrate.

In the aforementioned fifth heat pump, the aforementioned auxiliary fluid is preferably a portion of the decomposition liquid of the gas hydrate decomposed in the decomposer, and a valve is preferably disposed at the outlet section of the decomposer that divides the decomposition liquid of the gas hydrate between the compression system and the auxiliary fluid supply system.

In this case, the heat pump should have a temperature sensor that detects the temperature of the mixture of decomposition gas and decomposition liquid of the gas hydrate compressed in the compression system, and the valve should control the amount of decomposition liquid sent to the compressor based on the detected result of the temperature sensor as well as send remaining decomposition liquid to the auxiliary fluid supply system.

The heat utilizing apparatus of the present invention is a heat utilizing apparatus that performs heat transfer between itself and a heat source, and is equipped with a heat pump of the present invention as described above.

According to the aforementioned heat utilizing apparatus, energy efficiency can be improved as a result of using a heat pump having a high coefficient of performance.

BEST MODE FOR CARRYING OUT THE INVENTION

The following provides an explanation of the heat pump of the present invention.

A gas hydrate is an ice-like (or sherbet-like) compound (inclusion compound) in which gas molecules are enclosed in an inclusion matrix of water molecules. A gas hydrate generates heat in its formation process (process in which gas hydrate is formed from water and gas), and absorbs heat in its decomposition process (process in which gas hydrate is separated into gas and water). As a result of conducting extensive studies that focused on this general fact relating to gas hydrates along with the fact that gas hydrates have a larger latent heat of melting (heat of decomposition/formation) than ice, the inventors of the present invention determined that a heat pump having high energy efficiency can be composed by utilizing the transfer of heat accompanying the decomposition and formation processes of gas hydrates.

Namely, in the heat pump of the present invention, heat is imparted to a high-temperature objects in a gas hydrate formation process by taking up heat from a low-temperature object in a gas hydrate decomposition process by utilizing the heat of decomposition and formation of gas hydrates.

Figure 1:
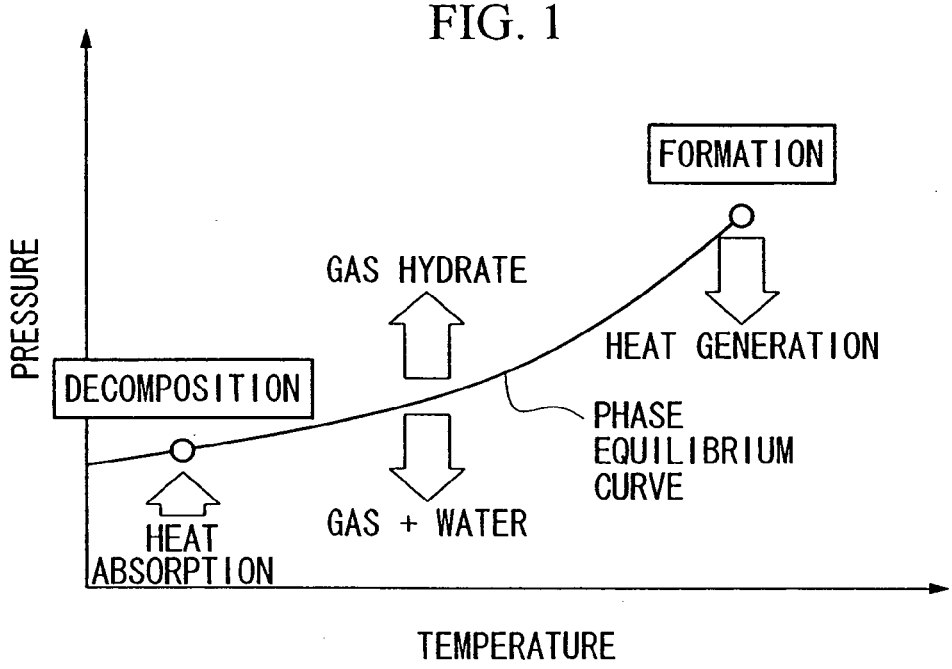
FIG. 1 is a drawing showing a typical phase equilibrium diagram of a gas hydrate.
Figure 2:
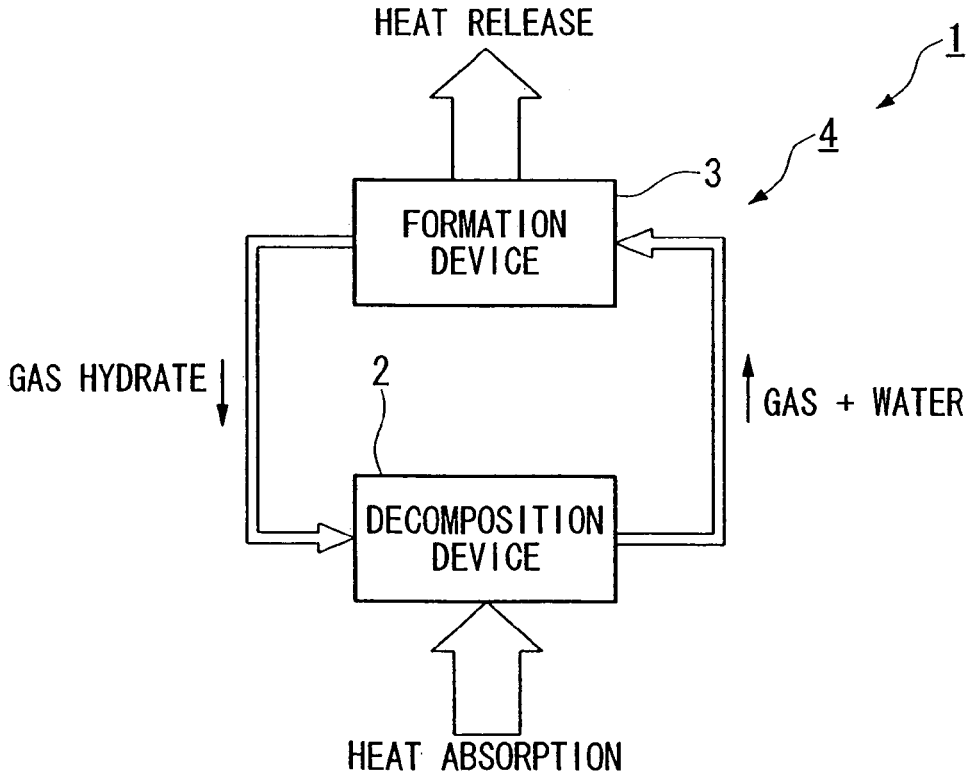
FIG. 2 is a drawing schematically showing the basic constitution of the heat pump of the present invention.

FIGS. 1 and 2 are drawings for explaining the operating principle of the heat pump of the present invention, with FIG. 1 indicating a typical phase equilibrium diagram of a gas hydrate, and FIG. 2 schematically showing the basic constitution of the heat pump of the present invention.

In FIG. 1, gas hydrates are in a stable or semi-stable state in the region above and to the left of the phase equilibrium curve. On the other hand, gas hydrates are unstable in the region below and to the right of the phase equilibrium curve, and separate into gas and water. As a result of decomposing a gas hydrate under conditions of low pressure and low temperature along the phase equilibrium curve and forming gas hydrate under conditions of high pressure and high temperature, heat on the low-temperature side can taken up to the high-temperature side.

In FIG. 2, a heat pump 1 is equipped with a refrigerant circuit 4 that contains decomposition device 2 that decomposes a gas hydrate and a formation device 3 that forms a gas hydrate. Decomposition device 2 has a decompression function and a heat absorbing function, while formation device 3 has a compression function and a heat releasing function. In decomposition device 2, a gas hydrate in a high-pressure, high-temperature state formed in formation device 3 is decompressed, and as a result of crossing the phase equilibrium curve shown in the aforementioned FIG. 1, is decomposed into gas and water. The temperature of the gas hydrate falls along the phase equilibrium curve while absorbing heat equivalent to the heat of decomposition from outside the cycle, resulting in a mixed phase of gas and water in a low-pressure, low-temperature state. On the other hand, in formation device 3, gas and water decomposed in decomposition device 2 are compressed resulting in a high-pressure, high-temperature state after which heat equivalent to the heat of formation is released outside the cycle. As a result of this release of heat, the mixed phase of gas and water crosses the phase equilibrium curve resulting in the formation of gas hydrate. Normally, at temperature higher than the freezing point of water (0° C.), the formed gas hydrate is in the form of a slurry that contains water. The formed gas hydrate is then decomposed again in decomposition device 2. As a result of this series of cycles, in the heat pump of the present invention, the heat equivalent to the heat of decomposition and formation of gas hydrate can be taken up from a low-temperature object outside the cycle and imparted to a high-temperature object outside the cycle.

Here, the gas hydrate is composed of a molecular structure in which a large number of water molecules surround a gas molecule, and in general, the hydration number (number of water molecules per gas molecule) is large. For example, the molecular formula of methane hydrate is expressed as $CH_4 5.75H_2O$ and the hydration number is 5.75. The heat of decomposition and formation of gas hydrates is comparatively large due to this characteristic of the molecular structure. For example, the heat of decomposition and formation of methane hydrate (dissociation enthalpy) is 1.3 times that of ice. In the heat pump of the present invention, a high output heating value with respect to input motive power, namely a high coefficient of performance (COP), can be obtained by utilizing this heat of decomposition and formation of a gas hydrate.

The following Table 1 shows the heats of decomposition and formation (MJ/kg of gas) and the COP in the case of using that gas hydrate in a heat pump are shown for several types of gas hydrates. Furthermore, COP was calculated based on the heat of decomposition and formation of each gas hydrate based on a value of 80% for the efficiency of the motive power source (e.g., compressor). Furthermore, an ordinary heat pump that utilizes the transfer of heat accompanying a cooling medium condensation process and evaporation process under the same conditions is 2.5 to 4.0 even for those offering high performance. As shown in Table 1 below, a heat pump that uses a gas hydrate can be seen to allow the obtaining of a high COP.

TABLE 1

| | Heat of decomposition/ formation | COP |
|---|---|---|
| Methane | 3.77 | 14.3 |
| Ethylene | 2.07 | 5.9 |
| Ethane | 2.27 | 10.6 |
| Acetylene | 2.22 | 7.1 |
| Propane | 3.02 | 34.8 |
| Carbon dioxide gas | 1.37 | 16.1 |
| HCFC141b | 0.89 | 10.5 |

Examples of gases that can be used for forming gas hydrates include hydrocarbon gases such as methane, ethane, propane, ethylene and acetylene, fluorocarbons such as HFC (e.g., R-22, R-123, R-124, R-141b, R-142b and R-225) and HCFC (e.g., R-134b, R-125 and R-152a) as well as carbon dioxide gas ($CO_2$), nitrogen, air, ammonia, xenon (Xe) and various other gases. Furthermore, in the heat pump of the present invention, the gas used for formation of a gas hydrate is not limited to the aforementioned gases. In order to obtain a high COP, it is preferable to use a gas having characteristics such as a high maximum equilibrium temperature, low equilibrium pressure, and low amount of change in pressure with respect to changes in temperature. Furthermore, these gases may be used alone or several types may be used in combination to obtain the desired characteristics. The conditions for phase changing of a gas hydrate can be adjusted by combining different types of gases. In addition, additives may be added to water to adjust the conditions for phase changing of a gas hydrate.

The heat pump of the present invention can be applied to an air-conditioner having at least one of the functions of cooling, heating, dehumidifying and humidifying. In addition, the heat pump of the present invention can also be applied to various heat utilizing apparatuses that transfer heat between itself and a heat source, examples of which include a cooling device (e.g., heat sink), heating device (e.g., floor heater), hot water device, freezing device, dehydration device, heat accumulator, snow melting device and drying device. The use of the heat pump of the present invention allows these heat utilizing apparatuses to obtain high energy efficiency.

The following provides an explanation of an example of applying the heat pump of the present invention to an air-conditioner as an example of a heat utilizing apparatus of the present invention.

Figure 3:
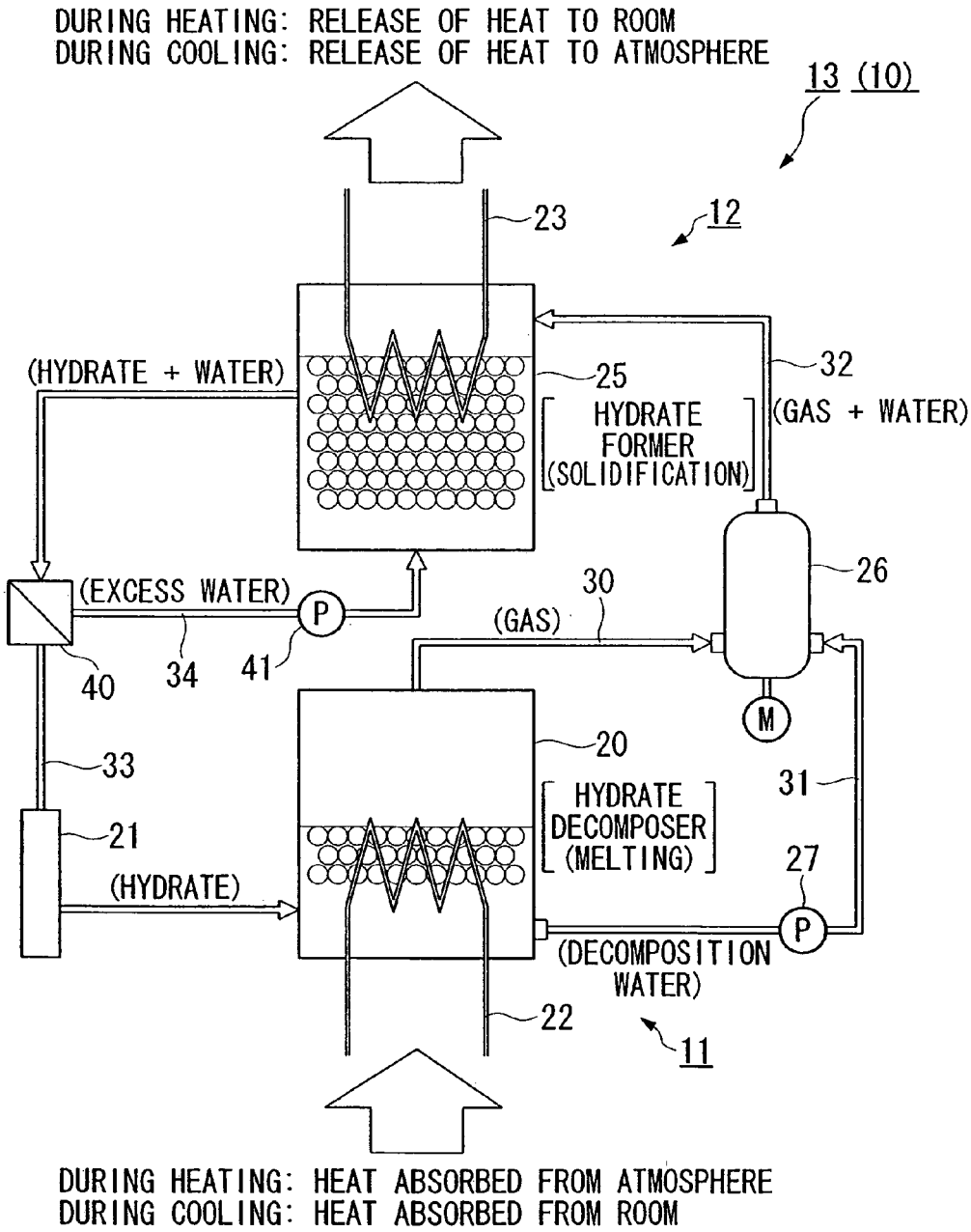
FIG. 3 is a block diagram schematically showing an embodiment in which the heat pump of the present invention is applied to an air-conditioner.

FIG. 3 is a block diagram schematically showing an embodiment in which the heat pump of the present invention is applied to an air-conditioner. This air-conditioner 10 has functions that cool and heat the air inside a room, and is provided with a refrigerant circuit 13 containing a gas hydrate decomposition device 11 and a gas hydrate formation device 12.

Decomposition device 11 has a decomposer 20 in which a gas hydrate decomposition process is carried out, a decompression unit that reduces the pressure of the gas hydrate (in the present example, a slurry pump 21 serving as a transport unit having a decompression function to be described later), and a first heat exchanger 22 that exchanges heat between a heat source outside the cycle (indoor air or outdoor atmosphere) and the gas hydrate.

In addition, formation device 12 has a former 25 in which a gas hydrate formation process is carried out, a compressor (compressor 26 and water pump 27) serving as a pressurizing unit that increases the pressure of the gas hydrate decomposition products, and a second heat exchanger 23 that exchanges heat between a heat source outside the cycle (indoor air or outdoor atmosphere) and the gas hydrate decomposition products.

Decomposer 20 and former 25 are mutually connected by means of lines 30 through 34. Lines 30, 31 and 32 are for sending the decomposition products (gas and water) of the gas hydrate decomposed in decomposer 20 to former 25. The gas hydrate decomposition products are decomposed into a gas and a liquid (water), with the gas flowing through line 30 and the water flowing through line 31. These lines 30 and 31 are each connected to compressor 26, and a water pump 27 for transporting water is arranged in line 31. Compressor 26 is composed so as to compresses water and gas from decomposer 20 while mixing, and then send that mixture to former 25 through line 32. The compression system in the present invention is composed by compressor 26, water pump 27 and lines 30, 31 and 32.

On the other hand, line 33 is for sending the gas hydrate formed in former 25 to decomposer 20, and a transport unit of slurry pump 21 that transports gas hydrate is arranged in line 33. Furthermore, as was previously described, this slurry pump 21 also functions as a decompression unit that decompresses gas hydrate from former 25 accompanying transport. Namely, the outlet of slurry pump 21 is connected to decomposer 20, and the pressure is lower as compared with the inlet connected to former 25. Consequently, the pressure of the gas hydrate is lowered as a result of passing through slurry pump 21.

In addition, an excess water separator 40, which separates excess water from the gas hydrate formed in former 25, is arranged in line 33. This excess water separator 40 is arranged on the side of former 25 with respect to slurry pump 21. Line 34 is for returning excess water separated in excess water separator 40 to former 25, and a transport unit in the form of water pump 41 that transports the excess water is arranged in line 34. Furthermore, each of the aforementioned lines 30 through 34 employ a heat-insulating structure through the use of a heat-insulating material and so forth. The excess water return system in the present invention is composed of water pump 41 and line 34.

Next, an explanation is provided of the operation of air-conditioner 10.

In decomposer 20, gas hydrate in a high-pressure, high-temperature state is decompressed by means of slurry pump 21. As a result, the gas hydrate is separated into gas and water. In addition, during this decomposition process, the temperature of the gas hydrate lowers as a result of absorbing heat equivalent to the heat of decomposition from a low level heat source (outdoor atmosphere or indoor air) outside the cycle by means of first heat exchanger 22, resulting in a mixed phase of gas and water in a low-pressure, low-temperature state. In addition, the decomposition products of the gas hydrate are separated into gas and water, with the gas and water being sent to former 25 through lines 30 and 32 and lines 31 and 32, respectively. At this time, the gas and water reach a high-pressure, high-temperature state as a result of being compressed by means of compressor 26 and water pump 27, respectively. As will be described later, the compressed gas and water are sent to former 25 after being mutually preliminarily mixed in the present example.

In former 25, heat equivalent to the heat of formation is released from the mixed phase of gas and water at a high-pressure, high-temperature state to a high level heat source (outdoor atmosphere or indoor air) outside the cycle by means of second heat exchanger 23. Accompanying this release of heat, the mixed phase of gas and water undergoes a phase change resulting in the formation of gas hydrate. The formed gas hydrate is in the form of a slurry that contains water, and is sent to decomposer 20 by means of slurry pump 21.

As a result of this series of cycles, heat equivalent to the heat of decomposition and formation of the gas hydrate is imparted to a high level heat source outside the cycle as a result of being taken up from a low level heat source outside the cycle in air-conditioner 10. The heat absorbed from outside the cycle during decomposition of the gas hydrate is released outside the cycle during formation of gas hydrate. High-temperature heat is used as heat for heating, while low-temperature heat is used as heat for cooling.

Namely, in air-conditioner 10, during heating of the inside of a room, together with gas hydrate being decomposed by decomposition device 11 while absorbing heat from the outdoor atmosphere, gas hydrate is formed by formation device 12 while releasing heat to air inside the room. During heating, the formation temperature of the gas hydrate is higher than the temperature inside the room, and is, for example, 25° C. or higher. In addition, the decomposition temperature of the gas hydrate is lower than the atmospheric temperature (atmospheric temperature in winter) and is, for example, 10° C. or lower. On the other hand, when cooling the inside of a room, together with the gas hydrate being decomposed by decomposition device 11 while absorbing heat from air inside the room, gas hydrate is formed by formation device 12 while releasing heat to the outdoor atmosphere. During cooling, the formation temperature of the gas hydrate is higher than the atmospheric temperature (atmospheric temperature in summer) and is, for example, 25° C. or higher. In addition, the decomposition temperature of the gas hydrate is lower than the temperature inside the room and is, for example, 10° C. or lower.

In this manner, according to air-conditioner 10, heat is transferred between heat sources by utilizing the heat of decomposition and formation of the gas hydrate. Consequently, energy efficiency can be improved by using the heat of decomposition and formation of the gas hydrate.

Here, in the air-conditioner 10 of the present example, the gas and water, which are the products of the decomposition in decomposer 20, are preliminarily mixed before being sent to former 25. Although the increase in temperature caused by compression is higher for the gas than for the water, as a result of the aforementioned mixing, heat exchange occurs between the compressed gas and water, which together with lowering the temperature of the gas, raises the temperature of the water. As a result, the mixed phase of gas and water reaches a temperature suitable for formation of gas hydrate, thereby increasing the formation efficiency of gas hydrate in former 25. In addition, since the water and gas are compressed while mixing in the present example, the heat generated by gas compression is transferred to the water, thereby inhibiting the temperature from rising within compressor 26. Consequently, there is the advantage of a high compression efficiency due to the cooling effects of compressor 26.

Namely, gas emitted from decomposer 20 (decomposition gas) is compressed and then sent to former 25. Since the temperature of the gas rises due to compression, there is the risk of reaching the formation temperature and causing a decrease in formation efficiency. High-temperature gas and low-temperature decomposition water (decomposition temperature=low temperature) are therefore mixed and compressed so as to reach a desired temperature (formation temperature) and then sent to former 25 to increase efficiency.

The mixing ratio of gas and water at the outlet of compressor 26 is determined based on the formation temperature of the gas hydrate in former 25. Namely, the aforementioned mixing ratio is determined so that the mixed phase of gas and water sent to former 25 reaches a suitable temperature for formation of gas hydrate. In addition, the mixing ratio is adjusted, for example, by adjusting the flow rate or pressure of the water and gas sent to compressor 26. In this case, at least a flow regulator valve or pressure regulator valve should be provided in gas line 30 or water line 31. These valves should then be adjusted so that the mixed phase of gas and water reaches the desired temperature. Furthermore, pressure may also be adjusted by adjusting the amount of decompression in decomposer 20.

In the air-conditioner 10 of the present example, the formation temperature of gas hydrate in former 25 is, for example, 45° C. (pressure of 1 MPa or less), while the decomposition temperature in decomposer 20 is, for example, about 5° C. In addition, the temperature of the decomposition gas flowing through line 30 is, for example, about 7° C., the temperature of the decomposition water flowing through line 31 is, for example, about 5° C., and the temperature of the mixed phase of gas and water at the outlet of compressor 26 is about 45° C. Furthermore, the aforementioned temperatures merely indicate examples of said temperatures, and the present invention is not limited to these temperatures.

In addition, in the air-conditioner 10 of the present example, excess water is separated from the gas hydrate formed in former 25. Namely, during the formation of a hydrate, since the efficiency improves the larger the amount of water than the theoretical hydration number, an excess amount of water relative to the amount of gas is supplied to former 25, and excess water is contained in the gas hydrate discharged from former 25. This excess water is separated from the gas hydrate by excess water separator 40 prior to decomposition of the gas hydrate. The separated excess water is returned to former 25 by means of water pump 41 and line 34 while at the same temperature.

The amount of excess water separated is determined so that the minimum required amount of water for transport of gas hydrate remains. Since excess water at the same temperature as the formation temperature is returned to former 25, an adequate amount of water required for formation is ensured thereby enabling stable formation of gas hydrate. In addition, the temperature of former 25 is prevented from lowering accompanying return of excess water by maintaining the temperature of the returned excess water at the same temperature as the formation temperature.

Namely, gas hydrate is formed at higher efficiency the larger the amount of water than the hydration number, excess water is required in former 25. Since the excess water during formation is at the formation temperature (higher temperature than the decomposition temperature), there is the risk of causing decreased efficiency of decomposer 20 when the excess water is sent to decomposer 20. Efficiency is therefore improved by separating the excess water immediately after it has been emitted from former 25 and then resent to former 25.

Moreover, the gas hydrate is efficiently decomposed in decomposer 20 as a result of the gas hydrate sent to decomposer 20 being dehydrated to a certain extent. Namely, since the temperature of the excess water is at the same temperature as the formation temperature, it is at a higher temperature than the decomposition temperature so that if the excess water is sent to decomposer 20, decomposer 20 would be warmed thereby resulting in the risk of a decrease in decomposition efficiency. Consequently, this decrease in the decomposition efficiency is inhibited by preliminarily separating the excess water from the gas hydrate sent to decomposer 20. Furthermore, in the air-conditioner 10 of the present example, in the case the formation temperature of the gas hydrate in former 25 is, for example, 45° C., then the temperature of the excess water returned to former 25 is also about 45° C.

Furthermore, various known technologies can be used for decomposition device 11 and formation device 12 in the aforementioned refrigerant circuit 13.

In decomposition device 11 shown in the aforementioned FIG. 3, although a composition is employed that uses both the gas hydrate transport function and decompression function during decomposition treatment of slurry pump 21, a pressure reducing means such as a pressure reducing valve may be provided separately. In addition, the decomposer itself may be given a decompression function, or a pressure reducing valve may be provided in the line for discharging gas decomposed in the decomposer. Regardless of which constitution is employed, as a result of continuously or intermittently lowering pressure with respect to the gas hydrate sent to the decomposer, decomposition of gas hydrate is accelerated and the gas (and water) generated by that decomposition is reduced in pressure and expanded.

In addition, first heat exchanger 22 provided in the decomposition device may exchange heat inside decomposer 20 or exchange heat outside decomposer 20. In the case of exchanging heat outside decomposer 20, first heat exchanger 22 is composed, for example, so as to exchange heat with a heat source outside the cycle while low-temperature water within the decomposer circulates through the lines. Alternatively, it may also be composed so as to exchange heat with a heat source outside the cycle by means of a cooling medium other than the gas hydrate. Furthermore, although the decomposition device preferably decomposes the gas hydrate continuously, that which decomposes the gas hydrate intermittently (batch system) can also be applied.

In the gas hydrate formation device, gas is required to be present in the former in an amount equal to or greater than the amount that dissolves in the water and becomes saturated, and fixed temperature and pressure conditions must be satisfied based on the phase equilibrium curve. In addition, in order to improve formation capacity in the former, the former is preferably composed to increase the contact surface area between the gas and water. Examples of technologies for increasing contact surface area include a method involving aggressive agitation of the gas and water, and a method in which gas is supplied to the water in the form of bubbles. Furthermore, since the gas hydrate has a high degree of gas retention due to the characteristics of its molecular structure as previously described, all of the voids in the gas hydrate need not be filled with gas molecules during formation. Although the formation device preferably forms gas hydrate continuously, that which forms the gas hydrate intermittently (batch system) can also be applied.

In the refrigerant circuit 13 shown in the aforementioned FIG. 3, although heat exchange is made to mutually take place between the decomposition products of the gas hydrate in the form of gas and water following their mixing, a cooler that cools the gas following compression may be provided to lower the temperature of the gas that has risen accompanying compression. In addition, in the aforementioned refrigerant circuit 13, although gas and water are mixed in compressor 26, the location where they are mixed is not limited thereto, but rather mixing is only required to take place before entering former 25. In addition, in the aforementioned refrigerant circuit 13, although the decomposition products in the form of gas and water are mixed followed by the mutual exchange of heat between them, they may be made to exchange heat by means of a heat exchanger without mixing. In addition, a tank may be provided that temporarily stores gas or water accompanying compression. Furthermore, the motive power of water pump 27 that compresses (or transports) the water is extremely small as compared with the motive power of compressor 26 that compresses the gas. In addition, various types of compressors can be applied for the compressor, examples of which include an electrical motorized compressor and a combustion type of compressor that uses gas fuel.

In addition, similar to the aforementioned first heat exchanger 22 of the decomposition device, second heat exchanger 23 provided in the formation device may perform heat exchange within former 25 or may perform heat exchange outside former 25. In the case of performing heat exchange outside former 25, second heat exchanger 23 is composed so that the mixed phase of high-temperature water and gas within the former is circulated through lines and heat exchanged with a heat source outside the cycle during that circulation. Alternatively, it may be composed so as to exchange heat with a heat source outside the cycle by means of a cooling medium other than the gas hydrate.

In addition, the gas hydrate formed in formation device 12 is in the form of a slurry that contains water. Consequently, it offers the advantage of being easily transported from formation device 12 to decomposition device 11 as compared with that in a hard, solid state. The means for transporting the gas hydrate is not limited to the aforementioned slurry pump, but rather another transport means may be used. In addition, the gas hydrate is not limited to being transported continuously, but rather may also be transported intermittently (batch system). In addition, the transport means may be omitted by utilizing a pressure difference between the former 25 and decomposer 20.

Figure 4:
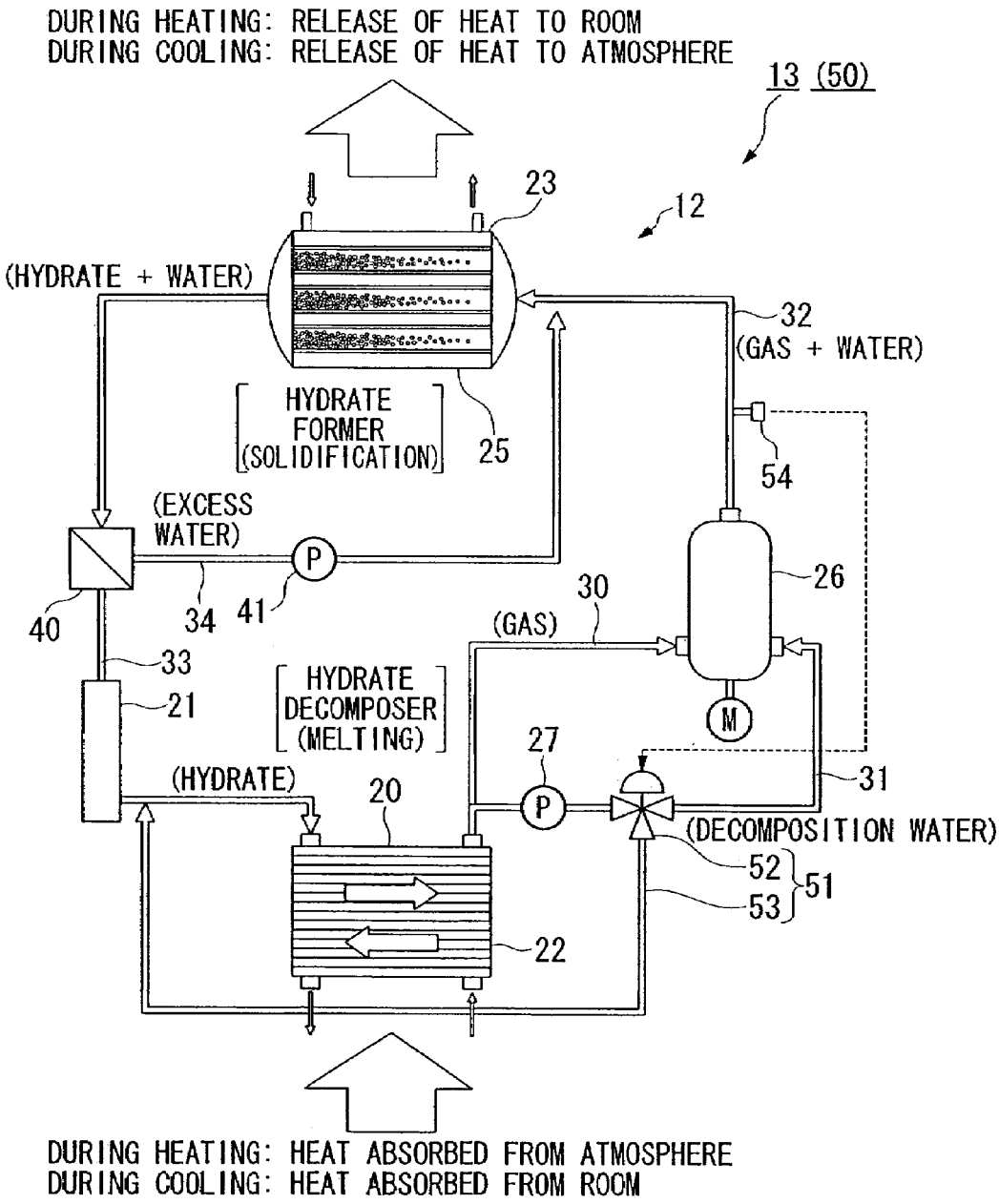
FIG. 4 is a block diagram schematically showing another embodiment in which the heat pump of the present invention is applied to an air-conditioner.

FIG. 4 is a block diagram schematically showing another embodiment in which the heat pump of the present invention is applied to an air-conditioner. Furthermore, in this example, the same reference symbols are used to indicate those constituent features that have the same function as the example shown in FIG. 3, and their explanations are either omitted or simplified.

As shown in FIG. 4, similar to the example of the previous FIG. 3, air-conditioner 50 of the present example has a decomposer 20 in which a gas hydrate decomposition process is carried out, and a former 25 in which a gas hydrate formation process is carried out, and is composed in the form of a heat pump that transfers heat between itself and a heat source by utilizing the decomposition and formation heat of a gas hydrate. In addition, differing from the example of the previous FIG. 3, the air-conditioner 50 of the present example is provided with an auxiliary fluid supply system 51 that supplies an auxiliary fluid (the decomposition water of a gas hydrate in the present example) for enhancing the fluidity of the gas hydrate to the inlet section of decomposer 20.

More specifically, auxiliary fluid supply system 51 is composed of a three-way valve 52 that is arranged in line 31 on the outlet side of decomposer 20 and extracts a portion of the decomposition water of the gas hydrate, and a circulation line 53 that leads the decomposition water extracted with this three-way valve 52 to the inlet of decomposer 20. Three-way valve 52 is composed so as to send a predetermined amount of the decomposition water emitted from decomposer 20 to gas compressor 26, and send the remaining decomposition water to circulation line 53. A temperature sensor 54 is arranged in line 32 on the outlet side of gas compressor 26 for detecting the temperature of the mixture (mixed phase) of gas (decomposition gas) and water (decomposition water) compressed and mixed in gas compressor 26, and three-way valve 52 controls the flow rate of decomposition water sent to gas compressor 26 based on the detection results of this temperature sensor 54. Furthermore, the value used to extract a portion of the decomposition water is not limited to a three-way valve, but rather may be composed by, for example, combining a plurality of flow control valves.

Here, the mixing ratio of gas (decomposition gas) and water (decomposition water) at the outlet of gas compressor 26 is determined based on the formation temperature of the gas hydrate in former 25 as was previously described. Namely, the aforementioned mixture is determined so that the mixed phase of gas and water sent to former 25 reaches a temperature that is suitable for formation of gas hydrate. In the case of the present example, the amount of decomposition water sent to gas compressor 26 is controlled by means of three-way valve 52 so that the temperature of the mixed phase of gas and water detected with temperature sensor 54 reaches a temperature suitable for the formation of gas hydrate. The remainder of the decomposition water is then sent from three-way valve 52 to the inlet of decomposer 20 through circulation line 53.

As a result of decomposition water being supplied to the inlet of decomposer 20 and that decomposition being mixed into the gas hydrate, the fluidity of the gas hydrate that flows through decomposer 20 is enhanced. Namely, since the gas hydrate that has passed through surplus water separator 40 only contains enough water required for transport, it lacks fluidity thereby resulting in the risk of the occurrence of problems (such as blockage) during transport within decomposer 20. However, as a result of introducing a portion of the decomposition water into the gas hydrate at the inlet of decomposer 20, the moisture content of the gas hydrate that flows to decomposer 20 is increased thereby resulting improved fluidity. As a result, transport problems within decomposer 20 are prevented. Furthermore, the distance of the lines extending from surplus water separator 40 to the transport means in the form of slurry pump 21 is preferably as short as possible in order to improve transport efficiency.

In this manner, in air-conditioner 50 of the present example, the fluidity of the gas hydrate in decomposer 20 can be enhanced by providing auxiliary fluid supply system 51. As a result, the decomposition efficiency of the gas hydrate can be increased, and the heat conversion efficiency with indoor air can be improved. In addition, as a result of improving the fluidity of the gas hydrate, a plate-type heat exchanger can be used for decomposer 20 (first heat exchanger 22). A plate-type heat exchanger is capable of highly efficient heat exchange, and since it also has a high degree of universality, offers the advantage of reducing the cost of the system.

In addition, in the present example, the auxiliary fluid that enhances the fluidity of the gas hydrate is the decomposition water immediately after it has left decomposer 20, thus resulting in a small temperature difference with the gas hydrate prior to entering decomposer 20. Consequently, there is little risk of the supply of auxiliary fluid causing decomposition of the gas hydrate to proceed prior to entering decomposer 20. Furthermore, the length of the lines from slurry pump 21 to decomposer 20 is preferably as short as possible in order to inhibit decomposition of the gas hydrate within the lines prior to entering decomposer 20.

In addition, since auxiliary fluid supply system 51 is a circulation system that circulates decomposition water in the present example, there is no risk of disturbing the flow balance of the medium within the cycle accompanying supply of auxiliary fluid. Consequently, stable performance is able to be demonstrated. Furthermore, a fluid other than decomposition water may be used for the auxiliary fluid. In the case of using another fluid, that fluid is preferably controlled to about the same temperature as the gas hydrate prior to entering the decomposer.

Although the preferred embodiments of the present invention have been described and illustrated above while referring to the attached drawings, it should be understood that these are exemplary of the invention are not to be considered as limiting. The forms, combinations and so forth of the constituent members indicated in the aforementioned embodiments are merely examples, and can be altered in various ways based on design requirements and so forth without departing from the scope of the present invention.

INDUSTRIAL APPLICABILITY

According to the heat pump of the present invention, a high coefficient of performance (COP) is obtained by utilizing the transfer of heat accompanying the decomposition and formation processes of a gas hydrate.

In addition, the decomposition efficiency of the gas hydrate in a decomposer is enhanced by separating excess water from the gas hydrate formed in a former.

In addition, the formation efficiency of the gas hydrate is enhanced by compressing and mixing a gas and liquid that are decomposition products of the gas hydrate decomposed in a decomposer, and then sending the resulting mixture to a former.

In addition, the fluidity of the gas hydrate in a decomposer is enhanced by supplying an auxiliary fluid to the inlet of a decomposer, which together with preventing problems during transport, improves the decomposition efficiency of the gas hydrate.

In addition, according to the heat utilizing apparatus of the present invention, energy efficiency can be improved by using a heat pump having a high coefficient of performance.

What is claimed is:

1. A heat pump, comprising:

a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process, and an excess water separator that separates excess water from the gas hydrate formed in the former, the gas hydrate after the separation of the excess water being supplied to the decomposer.

2. A heat pump according to claim 1 further comprising an excess water return system that returns excess water separated with the excess water separator to the former while maintaining its temperature.

3. A heat pump, comprising:

a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process, a first line though which gas flows, the gas being a decomposition product of the gas hydrate decomposed in the decomposer;

a second line through which liquid flows, the liquid being a decomposition product of the gas hydrate decomposed in the decomposer; and a compression system that is connected to the first and the second lines, and that mixes the gas from the first line with the liquid from the second line, and that sends the gas and the liquid to the former after compressing and mixing.

4. A heat pump, comprising:

a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process, an excess water separator that separates excess water from the gas hydrate formed in the former, the gas hydrate after the separation of the excess water being supplied to the decomposer, a first line though which gas flows, the gas being a decomposition product of the gas hydrate decomposed in the decomposer;

a second line through which liquid flows, the liquid being a decomposition product of the gas hydrate decomposed in the decomposer; and a compression system that is connected to the first and the second lines, and that mixes the gas from the first line with the liquid from the second line, and that sends the gas and the liquid to the former after compressing and mixing.

5. A heat pump, comprising:

a refrigerant circuit, which contains a decomposer in which a gas hydrate decomposition process is carried out, and a former in which a gas hydrate formation process is carried out and imparts heat to a high-temperature object in the gas hydrate formation process by taking up heat from a low-temperature object in the gas hydrate decomposition process, an auxiliary fluid supply system that supplies an auxiliary fluid for enhancing the fluidity of the gas hydrate to the inlet section of the decomposer, the auxiliary fluid being a portion of the decomposition liquid of the gas hydrate decomposed in the decomposer, and a valve that is disposed at the outlet section of the decomposer, and that extracts the portion of the decomposition liquid of the gas hydrate, and that sends that decomposition liquid to the auxiliary fluid supply system.

6. A heat pump, comprising:

a refrigerant circuit, which contains a decomposer in which a gas hydrate decomposition process is carried out, and a former in which a gas hydrate formation process is carried out, and imparts heat to a high-temperature object in the gas hydrate formation process by taking up heat from a low-temperature object in the gas hydrate decomposition process, an auxiliary fluid supply system that supplies an auxiliary fluid for enhancing the fluidity of the gas hydrate to the inlet section of the decomposer, and a compression system that sends gas and liquid which are decomposition products of the gas hydrate decomposed in the decomposer to the former after compressing and mixing.

7. A heat pump according to claim 6 wherein, the auxiliary fluid is a portion of the decomposition liquid of the gas hydrate decomposed in the decomposer, and a valve that extracts a portion of the decomposition liquid of the gas hydrate and sends that decomposition liquid to the auxiliary fluid supply system is disposed at the outlet section of the decomposer.

8. A heat pump according to claim 7 that has a temperature sensor that detects the temperature of the mixture of decomposition gas and decomposition liquid of the gas hydrate compressed in the compression system, and the valve controls the amount of decomposition liquid sent to the compressor based on the detected result of the temperature sensor as well as sends remaining decomposition liquid to the auxiliary fluid supply system.

9. A heat utilizing apparatus that performs heat transfer between itself and a heat source, and is equipped with a heat pump according to claim 1.

10. A heat utilizing apparatus that performs heat transfer between itself and a heat source, and is equipped with a heat pump according to claim 3.

11. A heat utilizing apparatus that performs heat transfer between itself and a heat source, and is equipped with a heat pump according to claim 4.

12. A heat utilizing apparatus that performs heat transfer between itself and a heat source, and is equipped with a heat pump according to claim 5.

13. A heat utilizing apparatus that performs heat transfer between itself and a heat source, and is equipped with a heat pump according to claim 6.

* * * * *